United States Patent [19]

Herbert

[11] Patent Number: 4,564,117

[45] Date of Patent: Jan. 14, 1986

[54] BOTTLE CLOSURE

[75] Inventor: James F. Herbert, Staffordshire, England

[73] Assignee: Metal Closures Limited, Staffordshire, England

[21] Appl. No.: 631,881

[22] Filed: Jul. 18, 1984

[30] Foreign Application Priority Data

Jul. 27, 1983 [GB] United Kingdom ..... 8320266

[51] Int. Cl.[4] ..... B65D 53/04

[52] U.S. Cl. ..... 215/329; 215/350; 215/351

[58] Field of Search ..... 215/329, 349, 350, 351

[56] References Cited

U.S. PATENT DOCUMENTS

| | | | |
|---|---|---|---|
| 2,130,749 | 9/1938 | Von Till | 215/350 |
| 2,748,969 | 6/1956 | Leary | 215/329 |
| 3,122,253 | 2/1964 | Hagmann et al. | 215/351 X |
| 3,207,350 | 9/1965 | Hagmann et al. | 215/351 X |
| 3,409,160 | 11/1968 | Scott | 215/351 X |
| 3,435,976 | 4/1969 | Owens | 215/329 |
| 3,973,690 | 8/1976 | Shneider | 215/350 X |

FOREIGN PATENT DOCUMENTS

| | | | |
|---|---|---|---|
| 547660 | 5/1956 | Belgium | 215/350 |
| 800422 | 12/1968 | Canada | 215/349 |
| 1488433 | 6/1967 | France | 215/329 |

*Primary Examiner*—Donald F. Norton
*Attorney, Agent, or Firm*—Roland T. Bryan

[57] ABSTRACT

A closure for an externally screw threaded standard glass or plastics container has a moulded plastics shell and a liner gasket which can turn freely in it. The liner is retained in the shell by a central spigot which fits loosely in a hole in the center of the liner gasket, but has an enlarged head.

The gasket, which is smaller in diameter than the top of the shell, is pressed against the top end of the container, for which it is designed, by one or two ribs. This arrangement allows the liner gasket to remain stationary on the container at the commencement of releasing the closure.

8 Claims, 1 Drawing Figure

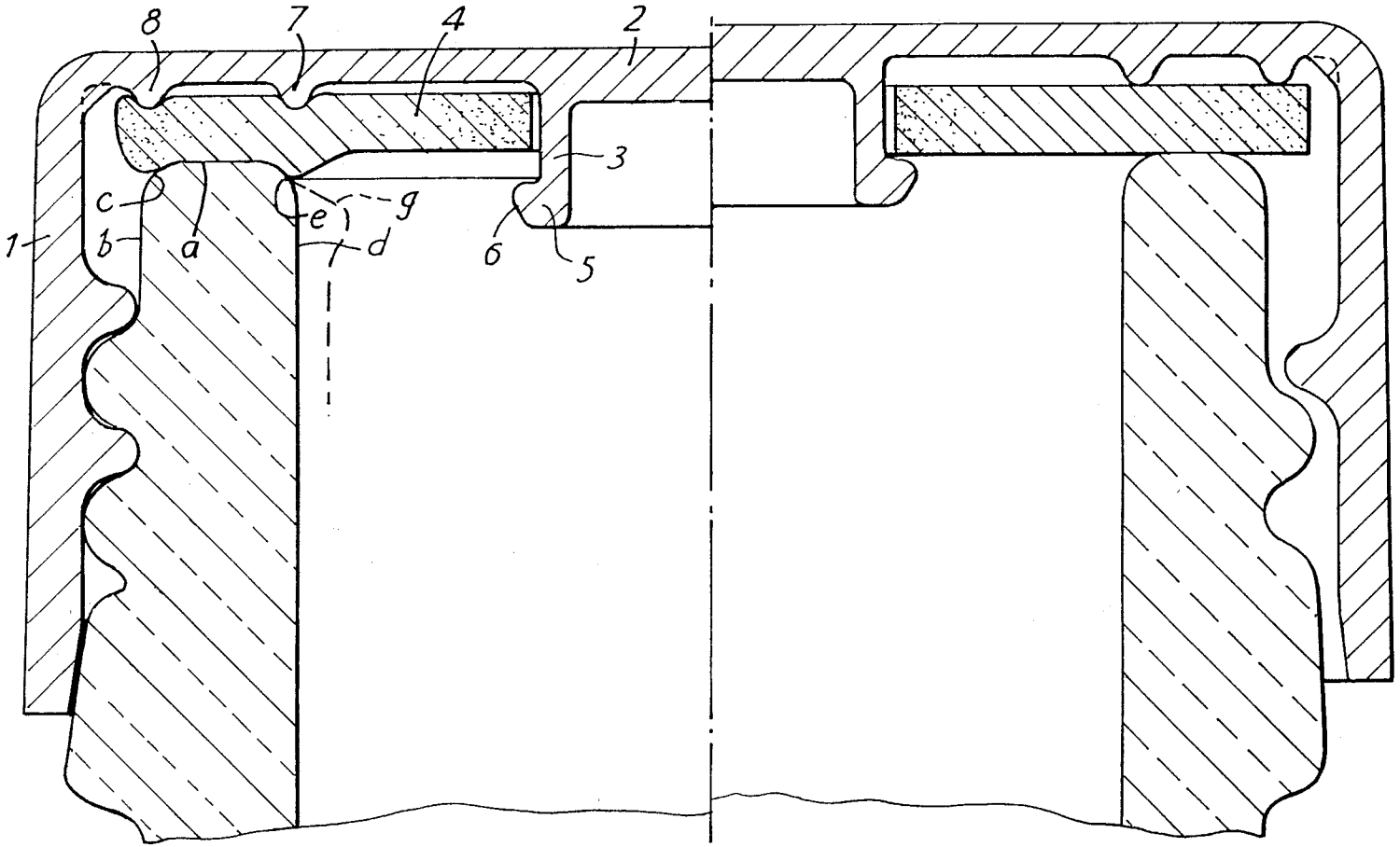
1
2
3
4
5
6
7
8
a
b
c
d
e
g

BOTTLE CLOSURE

The present invention relates to caps for bottles and like containers and is particularly concerned with moulded plastic closure caps for externally threaded bottles.

Although many proposals have been put forward for the production of plastic caps, having a integral sealing gasket, it is now generally recognized that such caps are unsatisfactory for maintaining pressure over liquids contained in glass bottles. Owing to the irregularities of commercial glass it is found desirable to employ a separate liner gasket made of softer, more readily compressible material than the strong tough plastics, such as polypropylene, required for the pressure-resistant shell of the cap.

The principal object of the present invention is to provide a simple and economical closure cap construction suitable for application to an externally threaded glass or plastics container. The closure cap of the invention is primarily intended to hold the contents of the container under superatmospheric pressure. Such contents will usually be a carbonated beverage. However the closure cap of the invention is also effective for holding the contents under atmospheric or subatmospheric pressure (vacuum).

In known containers there is provided an essentially flat sealing surface on the top end of the neck, which is joined by inner and outer rounded, usually radiused, corners with essentially cylindrical or conical sealing surfaces on the inside and outside of the neck. The closure cap of the present invention is intended to seal only against the top end surface and/or one or both of the rounded corner sealing surfaces.

A closure cap for a container for a carbonated beverage is intended not only to hold the intended degree of carbonation pressure from the time of filling up to the first opening of the filled container, but also to act as a re-closure after partial removal of the contents of the container. It is therefore important that the liner gasket should not become damaged during repeated opening and closing of the container.

Large glass bottles, for example having a capacity of one liter or more, are frequently used to-day for carbonated beverages and for economic reasons, such bottles are reusable, as opposed to the smaller, disposable one-trip bottle. Reusable glassware may incur small scale damage at the top sealing surface during repeated use and such damage, which results in sharp edges, may well escape detection during routine inspection.

It has usually been considered desirable that the liner gasket for a screw-threaded closure cap should be firmly bonded to the closure shell to turn with it, irrespective of whether the shell is metal or plastic. However that involves the liner skidding on the container sealing surface(s), both during tightening and loosening, with consequent risk of damage. The principal reason for bonding the liner gasket to the shell is to avoid "ballooning" of the gasket when the cap is loosened. Where the liner covers the whole of the top of the closure cap, gas may diffuse through the liner and, where the liner is not fully bonded to the shell, such gas, which is at the pressure of the container contents, may cause the liner to balloon when the pressure is released on opening the bottle.

The closure cap of the present invention is designed to overcome these and other difficulties associated with known container caps and in particular it is designed to allow the shell to skid on its liner gasket, while the gasket is held against rotation on the container by friction at completion of tightening or commencement of loosening.

In order to achieve the desired result the closure shell is a plastics moulding having an internally threaded skirt and a top panel having a central liner-retaining spigot and at least one shallow circular rib having a diameter which lies between the internal diameter and external diameter of the container neck adjacent the container mouth or lies very close to such diameter range, the liner gasket being an annular disc having an external diameter less than that of the underside of the shell top panel and having a central aperture which fits loosely around the central spigot on the shell, said spigot having an enlarged lower end for retention of said liner at a level above the upper end of the thread. The liner gasket is thus loose in the shell and is preferably stamped out of a tape of liner material in a conventional manner. However the gasket may alternatively be in the form of a premoulded annulus and may be somewhat thickened locally, particularly at or near its periphery. The liner may be made from solid or foamed material to increase compressibility.

The function of the rib or ribs on the undersurface of the top panel is to clamp the material of the liner against the top end (including one or both radiused corners) of the container so as to form a line of sealing contact therewith while at the same time holding the surface of the liner against the whole or a large portion of the top end surface of the neck so that the friction forces between the liner and the container neck are greater than the friction forces between the liner and the shell.

This is most conveniently achieved by positioning at least one rib in such a way that it bends the liner around one of the rounded corners.

The rib (or outermost rib) on the closure shell is preferably located at a position more or less over the outer radiused corner to obtain a sealing contact between the liner and such radiused corner surface. Such sealing contact may be obtained even where the rib is slightly outward of the corner surface. It is greatly preferred to provide a second rib. Where such second rib is provided it is preferably arranged in a similar relation to the inner rounded corner on the container. When the closure cap is constructed in that way, the portion of the liner between the inner and outer ribs is somewhat stretched across the upper end surface of the container for frictional engagement therewith, while the opposite surface of the liner may be essentially out of contact with the surface of the shell top panel between the ribs. To hold down the frictional force between the liner and the shell, the rib or ribs are narrow in relation to the width of the upper end surface of the container and are preferably rounded in section.

A particular advantage of sealing against the radiused corner or corners (as opposed to sealing against a cylindrical side surface) is that the torque necessary for releasing the cap, is usually lower.

Although more than two concentric ribs may be provided, in a preferred construction there are two concentric ribs. Conveniently the rib(s) project from the top panel by a distance of 2.43 to 0.55 mm, but the amount of this projection may be somewhat greater or less depending upon the compressibility of the liner material and the profile of the neck of the container. Thus the height of the crest of the ribs may be different from each other in some instances. However the thickness and profile of the ribs and the compressibility of the liner are adjusted to one another in such a manner as to hold the remainder of the surface of the top panel substantially out of contact with the liner or at the most in such light contact that little friction occurs between the liner and the surface of the shell between the ribs.

One form of closure in accordance with the present invention is shown is the accompanying drawing.

In the drawing the closure cap is shown as fitted to bottles having alternative neck finishes.

In both finishes the neck has an essentially flat top surface a, an essentially cylindrical external surface b, joined by an outer corner radius c.

In one neck finish there is an internal cylindrical surface d, which merges into the top surface through a corner radius e.

In a second neck finish the essentially flat top surface a merges into a shallowly inclined surface g.

The closure cap of the present invention is intended to seal with either type of glass neck finish.

The surfaces b and d are shown at maximum permissible diameter at the left hand side of the FIGURE and at minimum permissible diameter at the right hand side.

The closure comprises a moulded plastics shell, having an internally threaded skirt 1 and a top panel 2. The top panel carries a spigot 3, to retain a flat annular liner disc 4. The spigot 3 has an enlarged head 5, with a chamfered undersurface 6 to assist in the assembly of the disc 4 to the shell. The top panel 2 carries annular ribs 7 and 8, located to press down the sealing disc approximately against the inner and outer radiused corners e and c, respectively of the standard container neck. It will be seen that the distance between the crest diameters of the ribs 7 and 8 is preferably slightly less than the thickness, t, of the container neck, but greater than the width of the top surface a of the container neck.

With this arrangement the material of the liner disc 4 is always to some extent stretched across the top surface a of the container neck so as to promote friction between them. The same is true with the alternative form of neck finish, in which the liner is pressed into contact with the top end of the container at or near the junction of the surfaces a and g.

When the closure cap is fully tightened down as shown in the left hand side of the drawing the portion of the liner disc lying inwardly of the rib 7 is essentially out of contact with the under side of the top panel so that the space above it is at the container pressure. It may be desirable to provide a small number of radial ribs, preferably shallower than the annular rib 7, between the spigot 3 and rib 7 to hold this portion of the liner away from the top panel and thus ensure an escape route for gas pressure as the closure cap is loosened on the container. Such ribs would also serve to strengthen the shell and reduce the amount of "doming" due to internal pressure. However the central spigot provides substantial resistance to doming, in any event.

The external diameter of the liner disc 4 is not particularly critical, but should exceed the diameter of the outer rib 8, while being less than the internal diameter of the upper end of the skirt 1.

Although the closure cap of the invention finds its principal utility for reusable glass bottles, which are prone to small scale damage of the seaing surfaces, it is also useful for non-returnable glass and plastics bottles, particularly because of the relatively low opening torques, due to sealing along line contact(s) at or close to the radiused corner(s).

As already explained, in less preferred constructions the inner rib 7 may be omitted.

The assembly of the disc 4 to the shell presents no particular problems. In some instances the spigot of the shell, as moulded, is smaller than the aperture in the liner disc, but is post-formed to enlarge its lower end after insertion of the liner disc.

The closure cap shown in the drawing is preferably moulded in polypropylene or similar tough thermoplastics material. It may carry a security band of any desired pattern, either of the heat-shrink type or mechanical clipunder type, at its lower margin, since neither type will present any substantial obstacle to the insertion of the liner disc. The external surface of the closure shell may be patterned or plain. The upper surface of the top panel may be provided with radial or annular or other strengthening formations. Serration for gripping the closure cap would normally be provided on the external surface of the skirt.

I claim:

1. A closure device for a standard containerhaving an externally screw threaded neck and a mouth presenting an upwardly facing sealing surface, bounded by an outer rounded corner service, said closure comprising a moulded plastics shell and a substantially planar liner gasket supported in said shell, said shell comprising a top panel and an internally threaded shirt, said top panel carrying, on its under surface, a central spigot, having an enlarged lower end and having at least one circular rib near its periphery, said liner gasket having a control aperture, within which said spigot fits loosely, of smaller size than said enlarged lower end of the spigot, said gasket having an outer diameter which is larger than the external diameter of the neck of the container but which is smaller than the diameter of the undersurface of the top panel of said shell whereby said liner gasket may turn in relation to said shell.

2. A closure according to claim 1 in which said one rib has a diameter such that it is located close to the outer radiused corner of the container mouth.

3. A closure according to claim 1 in which there are two closely spaced concentric ribs.

4. A closure according to claim 3 in which the inner rib of said two ribs has a diameter such that it is located close to the inner margin of said upwardly facing sealing surface of said container.

5. A closure according to claim 1 including two spaced apart concentric ribs on the undersurface of the shell top panel, said ribs being spaced apart by a distance less than the thickness of the container neck but greater than the width of the upwardly facing sealing surface, said ribs being respectively located close to the inner and outer margins of said upwardly facing sealing surface.

6. A closure for a standard container having an externally screw-threaded neck and a mouth presenting an upwardly facing sealing surface, bounded by an outer rounded corner surface, said closure comprising a moulded plastics shell and a substantially planar gasket supported in said shell, said shell comprising a top panel and an internally threaded skirt, said top panel carrying on its undersurface a central spigot having an enlarged lower end, and said top panel having at least one circular rib near its periphery, said liner gasket having a central aperture, within which said spigot fits loosely, of smaller size than said enlarged lower end of the spigot, said gasket having a smaller diameter than that of the undersurface of the top panel of said shell whereby said liner gasket can turn in relation to said shell, the radial position of the rib being such that the rib presses the gasket into substantially line sealing contact with said outer rounded corner surface only.

7. A closure for a standard container having an externally screw threaded neck and a mouth presenting an upwardly facing sealing surface, bounded by an inner rounded corner surface and an outer rounded corner surface, said closure comprising a moulded plastics shell and a substantially planar gasket supported in said shell, said shell comprising a top panel and an internally threaded skirt, said top panel carrying on its undersurface a central spigot having an enlarged lower end, and said top panel having two concentric circular ribs radially spaced from each other between said spigot and the radially outer diameter of the undersurface of the top panel, said liner gasket having a central aperture, within which said spigot fits loosely, of smaller size that said enlarged lower end of the spigot, said gasket having a smaller diameter than that of the undersurface of the top panel of said shell whereby said liner gasket can turn in relation to said shell, the radial positions of said two ribs being such that the ribs press the gasket into substantially line sealing contact with said inner and outer rounded corner surfaces respectively.

8. A closure for a standard container having an externally screw-threaded neck and a mouth presenting an upwardly facing sealing surface, bounded by an inner rounded corner surface and an outer rounded corner surface, said closure comprising a moulded plastics shell and a substantially planar gasket supported in said shell, said shell comprising a top panel and an internally threaded skirt, said top panel carrying on its undersurface a cenral spigot having an enlarged lower end, and said top panel having two concentric circular ribs radially spaced from each other between said spigot and the radially outer diameter of the undersurface of the top panel, said liner gasket having a central aperture, within which said spigot fits loosely, of smaller size than said enlarged lower end of the spigot, said gasket having a smaller diameter than that of the undersurface of the top panel of said shell whereby said liner gasket can turn in relation to said shell, said ribs being spaced apart by a distance less than the thickness of the container neck but greater than the width of the upwardly facing sealing surface, said ribs being respectively located close to the inner and outer margins of said upwardly facing sealing surface.

* * * * *